United States Patent [19]

Frazier et al.

[11] Patent Number: 4,457,572

[45] Date of Patent: Jul. 3, 1984

[54] COUPLING NUT FOR AN ELECTRICAL CONNECTOR

[75] Inventors: Margaret J. Frazier, Sidney; Robert W. Brush, Sr., Unadilla, both of N.Y.

[73] Assignee: The Bendix Corporation, Southfield, Mich.

[21] Appl. No.: 431,973

[22] Filed: Sep. 30, 1982

[51] Int. Cl.[3] ..... H01R 13/629

[52] U.S. Cl. ..... 339/89 M; 339/DIG. 2

[58] Field of Search ..... 411/296, 299, 300; 285/82, 85, 86, 87, 88, 84; 339/90 R, 90 C, 89 R, 89 C, 89 M, DIG. 2

[56] References Cited

U.S. PATENT DOCUMENTS

| | | | |
|---|---|---|---|
| 3,587,032 | 6/1971 | Normann | 339/89 M |
| 3,601,764 | 8/1971 | Cameron | 339/DIG. 2 |
| 4,109,990 | 8/1978 | Waldron et al. | 339/113 R |

FOREIGN PATENT DOCUMENTS

| | | | |
|---|---|---|---|
| 1389839 | 1/1965 | France | 339/DIG. 2 |

*Primary Examiner*—John McQuade

*Attorney, Agent, or Firm*—C. D. Lacina; R. J. Eifler

[57] ABSTRACT

A coupling member (500) comprises outer and inner sleeves (410, 310) mounted for relative corotation about a connector shell (100) and about one another for rotational movement between locked and unlocked positions relative to a coil spring (322) carried by inner sleeve (310), the coil spring (322) being compressed radially inwardly by an inner wall (406) of outer sleeve (410) to drive medial tooth (318) of a spring beam (316) into a locked relation with ratchet teeth (138) disposed around the connector shell, rotation of outer sleeve (410) to a second position registering an undercut (408) in inner surface (406) with coil spring (322), whereby the coil spring expands into a relaxed position and means (422) for normally biasing the sleeves into the locked position.

12 Claims, 6 Drawing Figures

FIG. 1
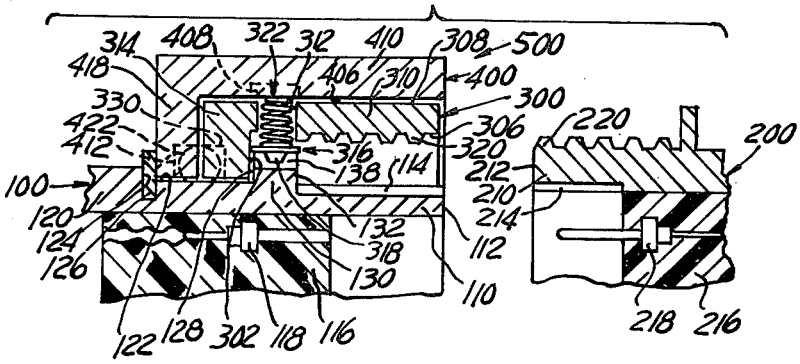
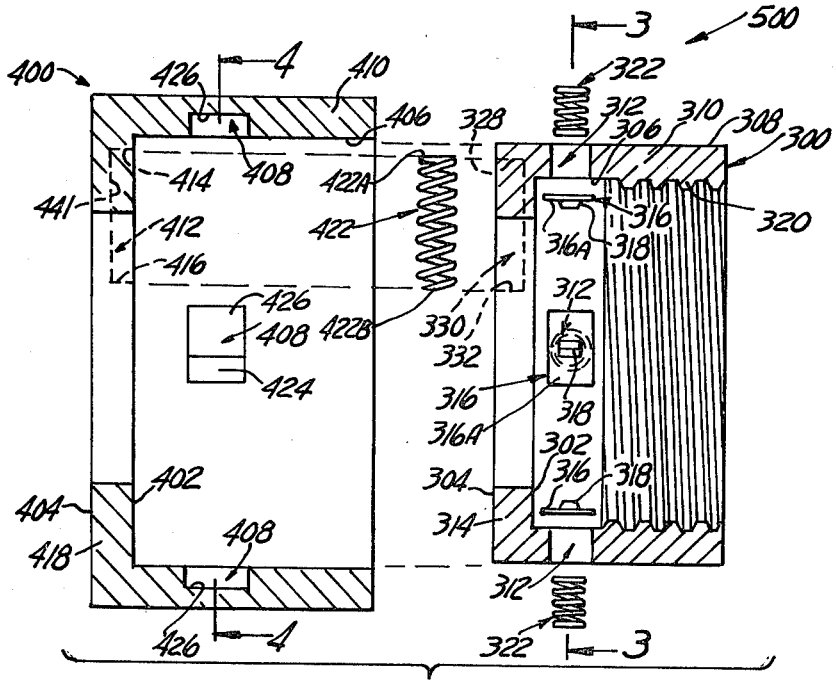
FIG. 2

COUPLING NUT FOR AN ELECTRICAL CONNECTOR

This invention relates to a compound coupling nut for an electrical connector including a spring beam normally resisting uncoupling and more particularly to a pair of coaxially mounted, relatively rotatable, sleeves adapted to corotate between locked and unlocked positions, respectively, to prevent and to allow rotation of the coupling nut.

An electrical connector assembly is generally comprised of two generally cylindrical connector shells with electrical contacts retained in one of the connector shells being mateable with electrical contacts retained in the other connector shell when the connector shells are connected together by a threaded coupling nut. The coupling nut includes a radial flange and is generally mounted to one connector shell by a retaining ring which rotatably captivates the radial flange adjacent an annular shoulder on the connector, rotation of the coupling nut interengaging the thread to axially draw the connector shells into their mated relation.

During mating and unmating, electrical connectors must be easily and quickly coupled and decoupled with use of reasonable forces. Once mated and in use, however, the electrical connector assembly must remain connected despite vibrational and/or other forces which might be applied to the connector assembly and which might tend to uncouple the connectors. Without more, frictional force between engaged thread flanks resist uncoupling rotation. Various anti-rotation devices to prevent unwanted backoff and/or disconnection between the connector parts are known.

In "Electrical Connector Assembly Having Anti-Decoupling Mechanism," U.S. Pat. No. 4,109,990 issuing Aug. 29, 1972 to Waldron et al, a straight spring beam has its ends mounted to a coupling nut and includes a medial tooth member co-acting with ratchet teeth disposed around an annular shoulder extending from the connector shell to resist rotation of the coupling nut relative to the plug shell. While the spring beam enhances resistance to uncoupling, the coupling nut may still tend to back off one or two clicks of ratchet teeth during some shock and/or vibration exposures and subject the connector shells to axial hammering.

This invention provides an electrical connector with a compound coupling nut having an anti-decoupling device that includes a coil spring which is normally in a compressed state so as to augment resistance to unwanted rotation but which may be substantially relaxed to an uncompressed state when an actuating sleeve is rotated in coupling and/or uncoupling directions. The coupling nut comprises a threaded coupling sleeve having a inner wall, a radial flange and a plurality of straight spring beams mounted generally equiangularly around the inner wall for resisting rotation when a medial tooth thereof is engaged with ratchet teeth on the connector shell.

The anti-decoupling device in accordance with this invention is characterized by the coupling sleeve registering a plurality of openings extending radially therethrough with one of the spring beams, an actuating sleeve having an inner wall co-axially disposed, corotatably mounted, about the coupling sleeve for turning from first to second positions and including on its inner wall a undercut comprising a cam leading to a recess, restoring means including a lost motion connection arrangement between the sleeves, which allows the actuating sleeve to rotate the recess from the first to the second position for normally biasing the sleeves into the first position, the first and second positions representing locked and unlocked positions wherein the coupling nut is prevented and permitted to rotate relative to the connector shell and a helical coil spring disposed in each of the openings around the coupling sleeve, the coil spring in the first position being compressed by the inner wall for biasing the medial tooth radially inward against the ratchet teeth to lock the coupling sleeve from rotation, the coil spring in the second position being relaxed by expansion into the undercut for allowing resisted rotation of the coupling sleeve.

One advantage of this invention is provision of stronger resistance to rotation between coupling nut and plug shell in order to maintain the coupling nut in its fully mated position when exposed to shock and vibration. Provision of a coil spring offers the advantage of selectively increasing compression on the straight spring beams and engaged teeth for preventing rotation the mated condition and releasing compression thereon during user desired uncoupling. Such an anti-decoupling device prevents undue wear between engaging teeth, spring fatigue and provides increased force only to prevent decoupling.

One way of carrying out the invention is described below with reference to the drawings which illustrate one specific embodiment of this invention, in which:

FIG. 1 is a side view, partially in section, of an electrical connector assembly having a coupling nut in accordance with this invention.

FIG. 2 is an exploded view, partially in section, of the coupling nut according to the present invention.

Figure 4:
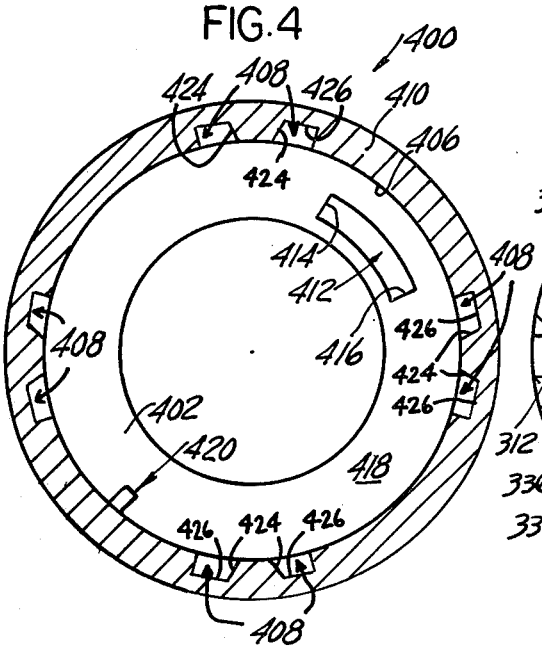
FIG. 4 is a section view taken along the lines IV—IV of an inner coupling sleeve shown in FIG. 2.

Referring now to the drawings and FIG. 1 in particular, an electrical connector assembly according to the present invention includes first and second shells 100, 200, positioned for mating engagement and a coupling member 500 mounted for rotation to first shell 100 for connecting the first shell and the second shells in mating relationship.

The first shell 100, also considered a plug-type connector, comprises a cylindrical front portion 110 having a front face 112 and a longitudinal key 114 on an outside surface thereof, a rear portion 120 and an annular shoulder 130 medially of the shell portions and having front and rear faces 132, 128 and a plurality of ratchet teeth 138 disposed around its circumference, a rearward annular wall 122 circumjacent annular shoulder 130 including a stepped groove 124 for receiving a retaining ring 126 and including a dielectric insert 116 mounted therewithin for retaining a socket-type electrical contact 118.

The second shell 200, also considered a receptacle-type connector, comprises a cylindrical front portion 210 having a front face 212 and including a keyway 214 on an inside surface thereof and external thread 220 on an outside surface thereof. Second shell 200 includes one or more pin-type electrical contacts 218 that mate within the socket-type contacts 118 of first shell 100, the pin-type contacts 218 being retained within a dielectric insert 216 mounted therewithin. Of course, the pin-socket contacts 218, 118 could be other than shown.

The coupling member 500 comprises a coupling nut 300 rotatably mounted on first shell 100, the coupling nut including a cylindrical coupling sleeve 310 having internal threads 320 on inner wall 306 thereof and an inwardly extending radial flange 314, the internal thread 320 being adapted to connect with the external thread 220 on second shell 200 to draw the first and second shells 100, 200 together with contacts 118, 218 mated and radial flange 314 being received about annular wall 122 and captivated for rotation against rear face 128 or annular shoulder 130 by retaining ring 126 received within stepped groove 124.

Rotation of coupling member 500 and alignment of key 114 with keyway 214 axially advances without rotation front portion 110 of first shell 100 inwardly into front portion 210 of second shell 200, the second shell 200 being drawn within coupling nut 300 and advancing until its front face 212 abuts front face 132 of annular shoulder 130 whereby metal-to-metal (i.e., full-mate) condition is achieved.

An anti-decoupling mechanism comprises coupling nut 300 carrying a plurality of straight spring beams 316 around inner wall 306, each spring beam having a medial tooth 318 adapted to be normally biased into engagement with ratchet teeth 138 for resisting rotation between coupling nut 300 and first shell 100.

Preferably and in accord with this invention, compound coupling member 500 comprises an actuating nut 400 coaxially disposed about coupling nut 300, the actuating and coupling nuts 400, 300 being mounted for co-rotation relative to one another and to plug shell 100, actuating nut 400 having a lost motion connection to the coupling nut 300 and adapted to rotate from a first position representing a locked condition and a second position representing an unlocking condition. Actuating nut 300 comprises a generally cylindrical actuating sleeve 410 having inner surface 406 and an inwardly extending radial flange 418, inner surface 406 being adapted to clearance fit about coupling sleeve 310 and having an undercut 408 (shown in phanton) therein and radial flange 418 being adapted to confront radial flange 314 and be captivated for rotation therewith and about annular wall 122. Shown in phantom, coupling member 500 includes a spring cavity 330 disposed in radial flange 314 confronting a spring cavity 412 disposed in radial flange 418, each of the spring cavities 330, 412 being in register with one another to define a spring housing sized to receive a helical coil operating spring 422, the operating spring transmitting force to the coupling nut as a result of relative rotation thereto by the actuating nut and normally biasing the respective nuts 300, 400 into the first position.

Coupling sleeve 310 includes inner and outer walls 306, 308 with a plurality of openings 312 extending radially therebetween, each opening 312 being circumposed in register with one of the spring beams 316. A coil spring 322 is sized to clearance fit within each opening 312 for biasing against the spring beam.

In the first position (shown) actuating sleeve 410 registers inner suface 406 thereof so that coil spring 322 mounted within a respective opening 312 of coupling sleeve 310 is compressed and biasing radially inwardly against spring beam 316. In the second position (see FIG. 6) undercut 408 is brought into register with coil spring 322 wherein coil spring 322 expands radially outwardly and relaxes.

FIG. 2 shows coupling member 500 with actuating nut 400 disassembled from coupling nut 300, coil springs 322 removed from openings 312 in coupling sleeve 310 and operating spring 422 removed from spring cavities 412, 330. Spring beam 316 is mounted to inner wall 306 of coupling sleeve 310 and positioned so that medial tooth 318 thereof faces inwardly but is aligned with opening 312.

Coupling nut 300 is one-piece and comprises cylindrical coupling sleeve 310 having inner and outer walls 306, 308, respectively, with inner wall 306 having internal thread 320 formed thereon and radial flange 314 having, respectively, inner and outer end walls 302, 304. Openings 312 are disposed equiangularly around the sleeve and extend radially inwardly between inner and outer walls 306, 308 circumjacent inner end wall 302 of radial flange 314. Spring cavity 330 (shown in phantom) is disposed in radial flange 314 and includes spaced spring seats 328, 332.

Actuating nut 400 is one-piece and comprises cylindrical actuating sleeve 410 having inner surface 406 and a plurality of equiangularly disposed undercuts 408 and radial flange 418 having, respectively, inner and outer end walls 402, 404, each undercut 408 being disposed radially inward of inner surface 406 and adapted to be registered with respective openings 312 on coupling sleeve 310. Each undercut 408 comprises a tapered surface defining a cam 424 and a radial wall 426 defining a recess to receive the coil spring. Spring cavity 412 extends into inner end wall 402 of radial flange 418 and includes spaced spring seats 414, 416.

Each of the spring cavities 330, 412 are arcuate and define, in combination, a spring housing sized to receive helical operating spring 422 with operating spring having opposite end faces 422A, 422B, respectively, abutting against spring seats 328, 414 and 332, 416 of the respective arcuate spring cavities. Operating spring 422 functions to constantly bias the coupling nut and actuating nut into the first (i.e., locked) position.

Figure 3:
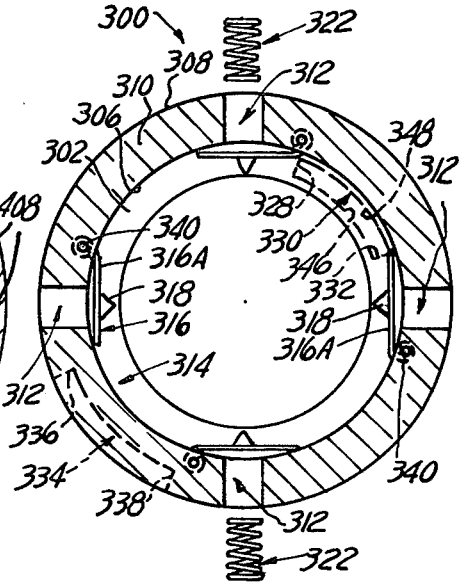
FIG. 3 is a section view taken along the lines III—III of an outer coupling sleeve shown in FIG. 2.

FIG. 3 is an end view of coupling nut 300 showing four straight spring beams 316 being disposed equiangularly around inner wall 306 of coupling sleeve 310, each spring beam 316 being pinned thereto by a peg 340 and including an elongated straight beam portion 316A and the medial tooth 318. Each opening 312 is disposed in register with medial tooth 318 and sized to receive a coil spring 322 therewithin. Spring cavity 330, shown in phantom, is arcuate and includes the spaced spring seats 328, 332 and inner and outer radial walls 346, 348.

An arcuate limit cavity 334, shown in phantom, including spaced sidewalls 336, 338, is disposed at the intersection of outer end wall 304 of radial flange 314 and outer wall 308 of coupling sleeve 310.

FIG. 4 is an end view of actuating nut 400 and, in accord with this invention, comprises four pairs of undercuts 408 disposed within inner surface 406 of actuating sleeve 410. Arcuate spring cavity 412 includes the spaced spring seats 414, 416. Each undercut 408 includes the tapering surface defining cam 424 leading to radial wall 426 defining the recess, the undercuts 408 being adapted to be rotated by the actuating nut from a first position where undercuts 408 are out of register with coil springs 322 and into a second position where undercuts 408 are in register with coil springs 322.

Spring cavity 412 is arcuate and comprises spaced spring seats 414, 416.

A drive foot 420 is disposed at the intersection of inner surface 406 of actuating sleeve 410 and inner end wall 402 of radial flange 418, the drive foot extending axially forward from radial flange 418 and being adapted to rotate between spaced sidewalls 336, 338 of limit cavity 334, engagement of either of the sidewalls by the drive foot constraining the coupling nut and actuating nut to rotate together.

Figure 5:
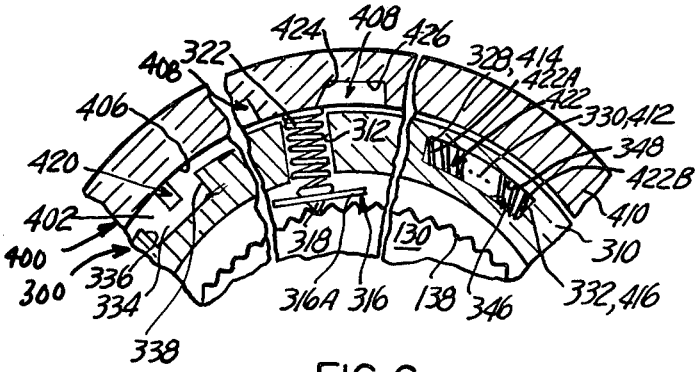
FIG. 5 is a partial section view of the assembled coupling sleeves and a spring beam in its locked position.

FIG. 5 shows an end view taken along different section cuts of coupling member 500 with the actuating nut 400 and coupling nut 300 disposing their respective sleeves 410, 310 in the locking first position. As shown, operating spring 422 is received within arcuate spring cavities 330, 412 with one spring end 422A abutting spring seats 328, 414 and opposite spring end 422B abutting spring seats 332, 416. This represents a rest position wherein undercuts 408 are not aligned with coil springs 322 and inner surface 406 of actuating sleeve 410 covers opening 312 to compress coil spring 322 radially inwardly and into biased relation against spring beam 316 to drive medial tooth 318 thereof into engagement with ratchet teeth 138 on annular shoulder 130. This is a "locked" position in that coil spring 322 is substantially compressed into a solid mass preventing any outward movement of medial tooth 318. Further, drive foot 420 is disposed within limit cavity 334 and medially of side walls 336, 338.

During initial coupling/uncoupling rotation, operating spring 422 provides a lost motion rotation of actuating sleeve 410 relative to coupling sleeve 310. That is, actuating sleeve 410 rotates but coupling sleeve 310 does not rotate until drive foot 420 abuts one of the side walls 336, 338, the abutting also defining rotation required to register undercuts 408 with coil springs 322.

Figure 6:
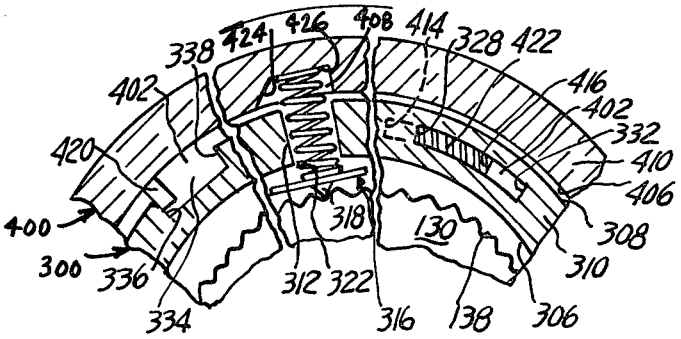
FIG. 6 is a partial section view of the inner and outer coupling sleeves during coupling rotation to a spring beam unlocked position.

FIG. 6 shows actuating nut 400 having been rotated to the second position relative to coupling nut 300 and drive foot 420 abutting against sidewall 336, thereby driving inner and outer sleeves 410, 310 as a unit. As a result of this rotation, undercut 408 advances into register with opening 312 whereby coil spring 322 expands radially outwardly to diminish its inward bias on spring beam 316 and reduce compression in coil spring 322. Preferably, during unlocking, coil spring 322 would be in a completely relaxed (i.e., extended) position. In the second and unlocking position, operating spring 422 is compressed between spring seats 328, 416 thereby tending to restore the nuts into their first position.

Although the description of this invention has been given with reference to a particular embodiment, it is not to be construed in a limiting sense, many variations and modifications possibly occurring to those skilled in the art.

We claim:

1. A coupling nut for an electrical connector of the type having first and second shells (100, 200) connectable in end-to-end relation, said first shell (100) including a plurality of ratchet teeth (138) and said second shell (200) including external thread (220), said coupling nut comprising a coupling sleeve (310) captivated for rotation about the first shell and including internal thread (320) for threadable coupling with the external thread (220) disposed on the second shell and a straight spring beam (316) having a medial tooth (318) normally in engagement with the ratchet teeth (138), rotation of the coupling nut drawing the shells (100, 200) axially together, said coupling nut characterized by:

a coil spring (322) carried by coupling sleeve (310) and cooperatively associated with spring beam (316) for biasing medial tooth (318) into engagement with ratchet teeth (138);

actuating means (406, 408, 410) operable between first and second positions, respectively, relative to the coupling sleeve for compressing and for relaxing the coil spring (322); and bias means (422, 330, 412) for constantly biasing the coil spring into the first position.

2. The coupling nut as recited in claim 1, characterized by said actuating means (406, 408, 410) comprising an actuating sleeve (410) having an inner surface (406) corotatably telescoped over part of said coupling sleeve (310), the inner surface (406) of said actuating sleeve including an undercut (408) adapted to be rotated into register with coil spring (322) and receive a portion of the coil spring expanded therein, said first position being such that coil spring (322) is compressed and has its opposite ends, respectively, abutting against spring beam (316) and inner surface (406), said second position being such that coil spring (322) is expanded into undercut (408) and not biasing against spring beam (316).

3. The coupling nut as recited in claim 2, characterized by each said sleeve (310, 410) having an inward radial flange (314, 418), said bias means (422, 330, 412) including each radial flange including, respectively, a spring cavity (330, 412) having spaced spring seats (328, 332; 414, 416), and an operating spring (422) disposed within each spring cavity, said operating spring (422) having its opposite ends operating, respectively, against the spring seats (328, 332; 414, 416), rotation of one radial flange (418) to a second position relative to the other radial flange (314) resulting in respective spring seats shifting relative to one another and compressing the operating spring (422) therebetween, the compressed operating spring tending to restore the radial flanges (314, 418) to their first position.

4. A coupling nut for an electrical connector of the type including a pair of mating shells (100, 200) having, respectively, mating faces (132, 212) and mating electrical contacts (118, 218) one shell (100) including a plurality of ratchet teeth (138) extending therearound, the coupling nut including a cylindrical coupling sleeve (310) captivated for rotation about one of the shells and provided with first thread (320) for threadably coupling with complementary second thread (220) disposed on the other of said shells and a spring beam (316) having a tooth (318) adapted to be normally biased into engagement with the ratchet teeth, rotation of the coupling nut drawing the shells (100, 200) together with the contacts (118, 218) mated and the faces (132, 212) in contact, said coupling nut characterized by:

said coupling sleeve (310) having inner and outer walls (306, 308) and including an opening (312) extending radially therethrough, said opening (312) being circumposed about said ratchet teeth (138);

an actuating sleeve (410) having an inner surface (406) coaxially disposed for rotation between locked and unlocked positions about coupling sleeve (310), said actuating sleeve having a plurality of undercuts (408) radially disposed in said inner surface (406);

lock means (322, 316, 318) for locking said sleeves and preventing relative rotation therebetween, said lock means including a resilient coil spring (322) disposed in opening (312) for biasing the spring beam (316) radially downwardly; and means (330, 412, 422) for constantly biasing said sleeves (310, 410) into the locked position, rotation of said actuating sleeve (410) bringing undercut (408) into register with coil spring (322) to allow the spring to extend.

5. An electrical connector having an anti-decoupling mechanism comprising: first and second shells (100, 200) connectable in end-to-end relation, said first shell (100) including a plurality of ratchet teeth (138) therearound and said second shell (200) including external thread (220) therearound; a coupling member (500) for securing the shells together, said coupling member comprising a coupling sleeve (310) rotatably mounted to first shell (100) having internal thread (320) for threaded connection to the external thread (220) of second shell (200) upon rotating coupling sleeve (310) in one direction relative to second shell (200) and including generally concentric inner and outer walls (306, 308); and an anti-decoupling mechanism for preventing rotation of coupling sleeve (310) relative to first shell (100), said anti-decoupling mechanism comprising a spring beam (316) having opposite ends mounted to inner wall (306) of coupling sleeve (310) and a medial tooth (318) normally engaging successive ratchet teeth (138) disposed around first shell (100) for resisting rotation, said anti-decoupling mechanism characterized by:

said coupling sleeve (310) including an opening (312) extending radially between its inner and outer walls and in register with said spring beam; and releasable locking means (312, 410, 408) movable between a locking position and a releasing position for locking the coupling nut and shells together in their connected relation, said locking means including a bias member (312) being disposed in said opening (312) biasing against spring beam (316) in the locking position and being unbiased against the spring beam in the releasing position.

6. The electrical connector as recited in claim 5, characterized by an actuating sleeve (410) having an inner surface (406) including an undercut (408) thereof corotatably telescoped over the coupling sleeve (310), said sleeves (310, 410) having a rotary lost motion connection therebetween whereby coupling sleeve (310) may be turned by actuating sleeve (410) being turned from the locking position and to the releasing position, said locking position registering inner surface (406) against bias member (322) and thereby compressing bias member radially inwardly against the spring beam to drive the medial tooth into the ratchet teeth and said releasing position registering undercut (408) with bias member (322) and thereby allowing the bias member to extend and diminish inward bias against the spring beam.

7. The electrical connector as recited in claim 5, characterized by said bias member (322) comprising a helical coil spring.

8. The electrical connector as recited in claim 6, characterized by a cam (424) being associated with said undercut (408), said cam (424) being adapted to allow gradual biasing and unbiasing to occur upon rotation of said actuating sleeve.

9. The electrical connector as recited in claim 6, wherein said coupling sleeve (310) includes a radial flange (314) and said first shell (100) includes an annular shoulder (130) for limiting axial movement of said coupling sleeve (310) therealong, characterized by said radial flange (314) including a spring cavity (330) having spaced spring seats (328, 332), said actuating sleeve (410) including a second radial flange (418) abutting the other radial flange, said second radial flange including a second spring cavity (412) having spaced spring seats (414, 416) and said rotary lost motion connection being characterized by said spring cavities abutting to form a spring housing and a helical operating spring (422) received in said spring housing and having its opposite ends acting against the spring seats in said radial flanges (314, 418).

10. The electrical connector as recited in claim 9, characterized by a limit cavity (334) having spaced sidewalls (336, 338) disposed in one sleeve being adapted to receive a drive foot (420) extending from the other sleeve, whereby as actuating sleeve (410) is corotated relative to coupling sleeve (310) the drive foot (420) advances in a lost motion to one sidewall and into contact therewith to constrain the coupling sleeve rotate with the actuating sleeve.

11. The electrical connector as recited in claim 10, characterized by said limit cavity (334) being disposed on radial flange (314) of coupling sleeve (310) and drive foot (420) being disposed on radial flange (418) of actuating sleeve (410).

12. The electrical connector as recited in claim 6, characterized by said coupling sleeve (310) being provided with a plurality of spring beams (316) and their associated bias members (322) disposed in respective openings (312) on the coupling sleeve (310) circumposing the ratchet teeth (138).

* * * * *